US007398628B2

(12) United States Patent
Van Horne, Jr.

(10) Patent No.: US 7,398,628 B2
(45) Date of Patent: Jul. 15, 2008

(54) METHOD AND APPARATUS FOR LAYING FLOORS

(76) Inventor: Jefferson Van Horne, Jr., 509 Lewis St., Monroe, WA (US) 98272

( * ) Notice: Subject to any disclaimer, the term of this patent is extended or adjusted under 35 U.S.C. 154(b) by 749 days.

(21) Appl. No.: 10/845,437

(22) Filed: May 13, 2004

(65) Prior Publication Data

US 2005/0252167 A1 Nov. 17, 2005

(51) Int. Cl.

| | |
|---|---|
| ***E04D 15/00*** | (2006.01) |
| ***E04F 21/00*** | (2006.01) |
| ***E04F 15/00*** | (2006.01) |
| ***E04G 21/14*** | (2006.01) |
| ***B66F 3/00*** | (2006.01) |
| ***B25D 1/00*** | (2006.01) |
| ***B25D 1/16*** | (2006.01) |

(52) U.S. Cl. ..... 52/749.1; 81/27; 81/46; 254/11

(58) Field of Classification Search ..... 52/749.1; 29/525; 254/11; 81/27, 46; 269/43
See application file for complete search history.

(56) References Cited

U.S. PATENT DOCUMENTS 4,837,940 A * 6/1989 Mahan ..... 33/624
5,819,393 A * 10/1998 Bockart et al. ..... 29/525
5,845,548 A * 12/1998 Nelson ..... 81/46
5,881,531 A * 3/1999 Bitner ..... 52/749.1
5,984,271 A * 11/1999 Ellenberger ..... 254/11

* cited by examiner

*Primary Examiner*—Brian Glessner
*Assistant Examiner*—Branon C Painter
(74) *Attorney, Agent, or Firm*—Mark Zoyko

(57) ABSTRACT

A tool and method for abutting an individual floor panel which is near an obstruction, such as a wall, to the assembled floor. The tool and method provide a rod having a flanged member at one end. The flanged member has a notch in its vertical flange which contacts the floorboard to be abutted, requiring a minimal amount of space between the obstruction and floorboard to be set. A sliding weight mounted on a rod can then be slid toward an impact surface resulting in a horizontal force being applied to the individual floorboard thereby abutting or setting that floorboard with respect to the assembled floor. An especially useful application for the device and method is in the installation of a tongue-in-groove laminate floor in which the individual floorboards have a tongue and groove connection on their ends.

18 Claims, 3 Drawing Sheets

METHOD AND APPARATUS FOR LAYING FLOORS

BACKGROUND OF THE INVENTION

1. Field of the Invention

This invention relates in general to a tool for facilitating the laying of a floor, and more particularly to a method and device for "setting" or abutting a laminate wood floor panel adjacent to an obstruction to the previously assembled floor.

2. Discussion of the Prior Art

There are many ways in which to force objects which are adjacent to one another snugly together. The simplest way, of course, is to simply provide a force transverse to the length of the two objects by using a device such as a hammer or rubber mallet. This is accomplished by building up linear momentum in the hammer and then directly imparting that momentum into the side of the object by direct contact. Thus the momentum is transmitted to the object, which is then forced via the transverse momentum snugly against the adjacent object. This simple methodology fails, however, when there is insufficient space to build momentum in such a way that it can be imparted to the object in a direction that will force the object against the adjacent object.

This realization is very important in the flooring industry and particularly in the wood flooring industry. Wood floors are installed by placing individual wood flooring boards on the surface on which they are to be installed and then providing a force to the side of one board to snugly force it against the adjacent board so that there are no gaps or space between the individual boards. This is a very simple process so long as there is sufficient space on the side of the board which is to be forced so one can generate a linear momentum. Imparting a force becomes significantly more difficult as this area to create a force diminishes. For example, when installing the last wood flooring board, usually a wall is immediately adjacent. It is, therefore, impossible to generate momentum with a hammer or rubber mallet as you cannot swing the hammer in such a way as to impart a force in a direction that would force a wood flooring board against an adjacent wood flooring board.

At this point, it is worthwhile to look at one or two examples of prior art solutions to the above mentioned problem of setting or abutting a floor panel next to an obstruction such as a wall. Two patents have surfaced from a preliminary search and show the shortcomings of the prior art. U.S. Pat. No. 5,984,271 issued to Ellenberger, and U.S. Pat. No. 5,819,393 issued to Bockart et al show two similar embodiments. Both of the patents show tools which sit on the assembled floor, have a sliding component which generates momentum, and have an end block or member which contacts the floorboard to be abutted. In contrast with the present invention, both of these patents have the following disadvantages. Initially, the device used in the two patents contacts the floor to some degree, setting up a possibility that the assembled floor, during operation of the apparatus, could be marked or damaged in some way. Further, the devices of both patents impart a "lifting force" on the device as the sliding hammer body is slid to the impact member of the device. The end member contacting the board to be abutted is a vertical surface, and the vertical surface is flush against the board. When the tools in both of the above mentioned patents are used, a horizontal force is generated against the floorboard to be set. A vertical component or lifting force, however, is also generated which tends to "lift" the board to be set to a degree. This "lifting" force on the floorboard and assembled floor is highly undesirable and is also absorbed by the device itself adding a wear component to the tool. A further disadvantage to the above two mentioned patents is that the space required behind the floorboard to be set is greater than the present invention. This relatively large space required is due in part to the general application of those tools. The general objective or application of both of the tools in the above two patents is to abut floorboards in a side-to-side manner. In an application, however, such as laying a laminate tongue-in-groove hardwood wherein the tongue and groove were located at the ends of the floorboard, problems would be presented for those tools. The device of the present invention requires less space behind the floorboard to be set than the tools of the prior art and is specifically useful for use with laminate floors which have a tongue and groove connection at the ends of the individual floorboards. In particular, it is especially difficult to set the end of a laminate floorboard where that board meets a wall or other obstruction. The present invention can fit easier into these tighter spaces due to its structure. Typically, the present invention can be fit into a 3/16-inch space between the end of the board and the obstruction. It can be mentioned that using the present invention, existing, potentially hard to match narrow trim panels can be removed from a wall and re-used. Further, the present invention, due to its structure, can be used under the toe-kick of a cabinet, as it can be "rolled" out of a tight space. With respect to the other disadvantages previously mentioned, it can be noted that the present invention, due to the structure of the member contacting the floorboard, will impart only a horizontal linear force to the floorboard with a negligible vertical or "lifting" component. It can be readily appreciated that no lifting pressure on the floorboard, assembled floor, or device during operation is highly desirable. Also the device of the present invention has minimal contact with the assembled floor surface. As will be described subsequently, only a plastic ring contacts the assembled floor in a very small area. Dirt or grit, etc. caught underneath the device and causing damage, such as scratches, during operation is not a factor. One last thing that can be mentioned regarding the above two patents when compared to the present invention is that the installer's hands are kept away from the impact area of the sliding weight. The handle provided with the device of the present invention adds a factor of safety and control compared to the prior art.

SUMMARY OF THE INVENTION

This invention provides a method and apparatus for setting or abutting an individual floorboard or an individual section of laminate flooring to an assembled floor which is especially useful in situations where obstructions prevent the use of other setting or abutting devices or techniques. The apparatus of the invention provided includes a rod having at one end a flanged member. The flanged member has a notch in its vertical flange which, when the apparatus is in use, contacts the edge of a floorboard to be abutted. One surface of the notch contacts the top surface of the floorboard and another surface of the notch contacts the side of the floorboard. The floorboard is thereby prevented from lifting upwardly during use of the apparatus by its contact on its top surface with one surface of the notch. The rod has a weighted member slidably engaged thereon which can build momentum in a horizontal direction as it slides on the rod. An impact member is provided on said rod which serves to receive the impact of the sliding weighted member when the apparatus is in use. When the weighted member contacts the impact member, the momentum generated by the sliding weighted member is transferred in a horizontal direction to the floorboard contacted by the notch of the flanged member and the individual floorboard is thereby "set" or abutted to the assembled floor. When the term floorboard is used, it should be pointed out that this term can encompass an individual piece of laminate flooring or any other wooden flooring. The apparatus is also provided with a stabilizing ring. The stabilizing ring is connected to the rod adjacent the impact member but outside of the impact member relative to the weighted member. The stabilizing ring is preferably plastic and has minimal contact with the assembled floor during use of the apparatus. It can be easily appreciated that the stabilizing ring keeps the rod in a horizontal direction and serves in general to support the apparatus on the assembled floor when in use. A handle is also provided for easier operation of the apparatus. In operation of the apparatus, an operator can grab the handle with one hand and slide the weighted member along the rod with the other hand as the stabilizing ring rests on the assembled floor and the notch of the flanged member engages the individual floorboard to be set. Use of the apparatus insures a horizontal force being applied to the floorboard to be set without any substantial unwanted vertical or lifting force.

The method provided by the invention, is especially useful for setting or abutting the final floorboard adjacent an obstruction especially when the obstruction is in close proximity to the floorboard. In the method of the invention, the flanged member with the notch therein is placed against the floorboard to be abutted. The floorboard to be abutted would be contacted on its upper surface by the horizontal surface of the notch, and along its side surface by the vertical surface of the notch. To generate the needed horizontal force to set the floorboard, the rod has a weighted member which slides along the rod and can build momentum as the weighted member slides away from the flanged member. An impact member is provided in the form of a nut attached to the rod, in the preferred embodiment, so that when the weighted member is slid on the rod toward the impact member and contacts the impact member, momentum generated by the sliding weighted member is transferred to the floorboard to be set in a horizontal direction thereby setting or abutting the floorboard to the assembled floor. To facilitate practice of the method, a stabilizing ring adjacent to the impact member or nut is provided. The stabilizing ring is located on the rod outside of the nut relative to the weighted member and rests on the assembled floor during practice of the method. The stabilizing ring insures the rod is relatively stable during practice of the method and in a substantially horizontal orientation relative to the floor. A handle is also provided at one end of the rod, the end opposing the flanged member. In practice of the method of the invention, therefore, an operator can grab the handle with one hand and use the other hand to slide the weighted member along the rod until impact with the nut. Both the apparatus and method of the invention are especially useful when the individual floorboards to be set are laminate floorboards having a tongue and groove connection at their ends.

An object of the invention, therefore, is to provide a tool and method for setting individual floorboards which are in close proximity to an obstruction in an easy and efficient manner.

Another object of the present invention is to provide a method and tool for setting individual floorboards close to obstructions which prevent damage to the floorboards.

A further object of the present invention is to provide a tool and method for abutting a floorboard to an assembled floor near an obstruction which is relatively safe and also prevents damage to the obstruction.

Yet another object of the present invention is to provide a device and method for abutting floorboards for use with laminate floors that have a tongue and groove connection on the ends of the floorboards.

A further object of the present invention is to provide a device for abutting floorboards which minimally impacts the assembled floor during normal use.

These and other objects and advantages will become more apparent from the following detailed description when taken in conjunction with the attached drawings.

DETAILED DESCRIPTION OF THE PREFERRED EMBODIMENT

Figure 1:
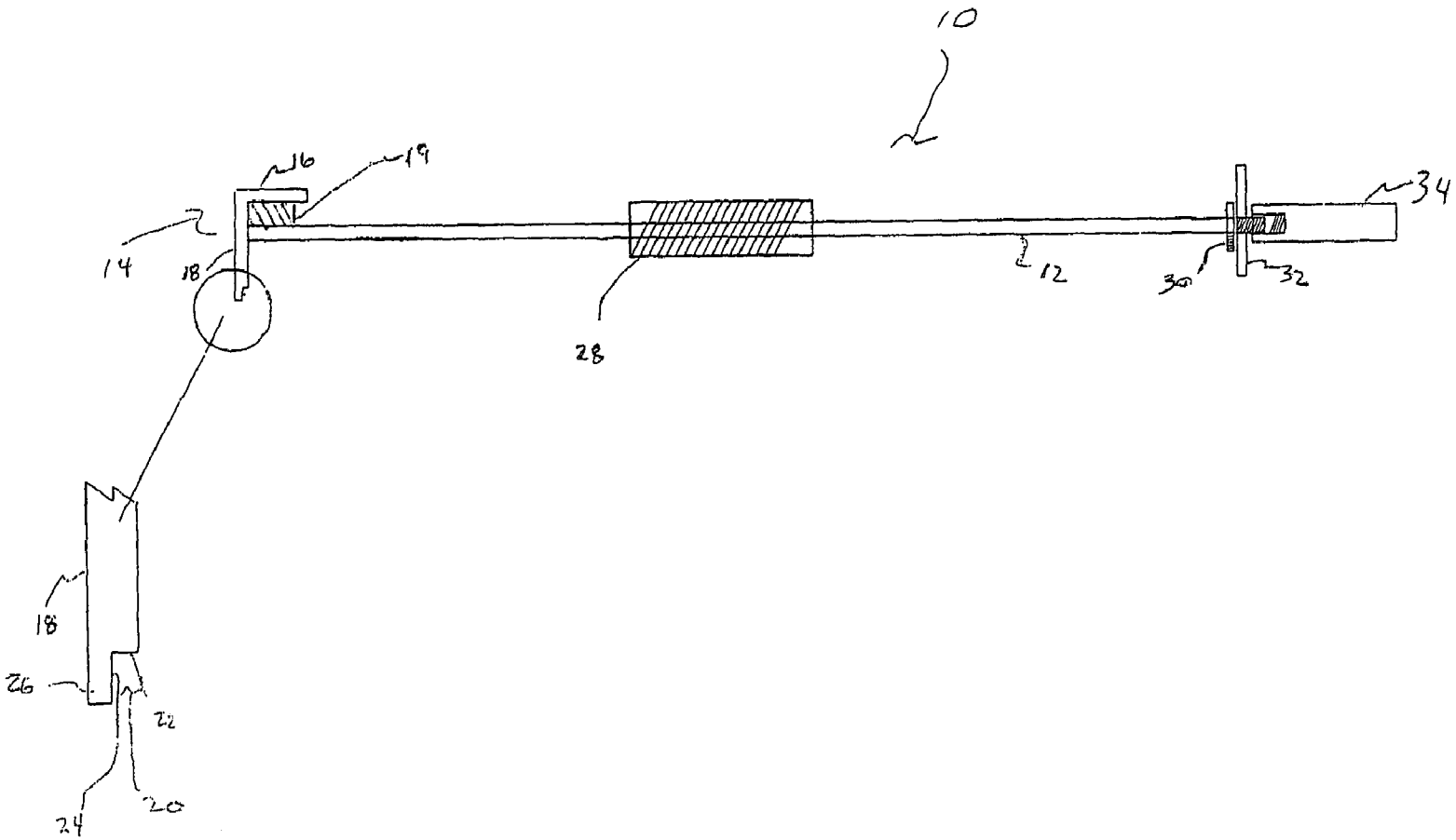
FIG. 1 is a side view of the apparatus of the invention showing its component parts.

Referring to the figures, a tool 10 for abutting or "setting" individual floor panels in an assembled floor near an obstruction can be described. The tool has a rod 12 having a flange 14 attached thereto. The flange 14 has a horizontal portion 16 and a vertical portion 18. Preferably the flange 14 can be made from 2"×3" angle iron. The rod 12 is attached to the vertical portion 18 of the flange 14. A web section 19 is welded between the rod 12 and flange 14 to add stability to the rod and flange connection. The vertical portion 18 of flange 14 has a notch, designated as 20 in the figures. Notch 20 is defined by a horizontal surface 22 in vertical portion 18 of flange 14, and a vertical surface 24 in vertical portion 18 of flange 14. The notch 20 also leaves a narrow end portion, designated as 26, at the bottom of vertical portion 18 of flange 14. To put the general dimensions in context, the end portion would preferably have a width of ⅛".

A weighted cylindrical slide 28 is slidably attached to rod 12. The weighted slide 28 can be easily slid along the length of the rod 12. At one end the weighted slide 28 is bounded by vertical portion 18 of flange 14. At the opposite end, the weighted slide 28 contacts a nut 30 which serves as an impact surface during operation of the tool. The nut 30 is threaded to rod 12 forming a solid fixed impact surface. On the side of nut 30 opposite of weighted slide 28, a stabilizing ring 32 is provided. The stabilizing ring 32 is preferably made of plastic, with a thickness of ¼". A handle 34 is also provided behind the stabilizing ring 32. Handle 34 is threaded to rod 12.

Figure 2:
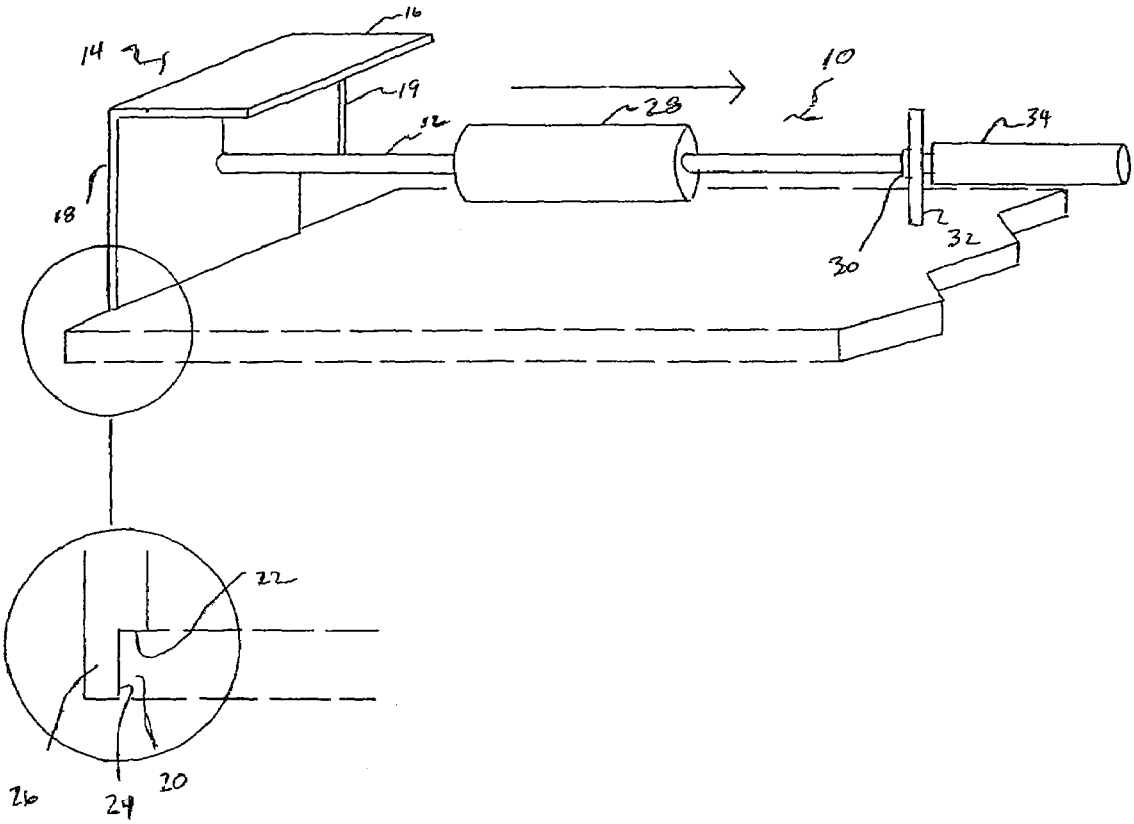
FIG. 2 is an isometric view of the invention in place on an assembled floor.
Figure 3:
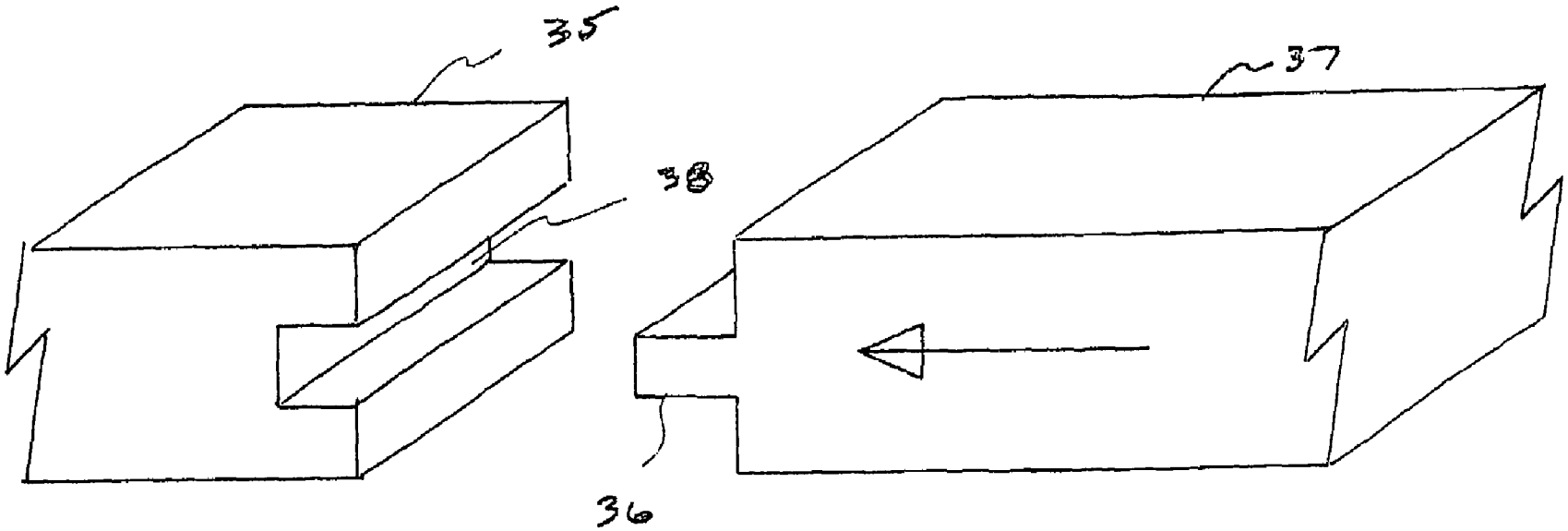
FIG. 3 is a pictorial view partially in section of two individual panels of a laminate floor showing a tongue and groove connection at the ends of the panels.

The operation of the tool 10 can be readily described using the attached figure, especially referring to FIG. 2. The operation of the tool is started by placing the flanged member against the side or end surface of an individual floor panel to be set in an assembled floor. The individual floorboards can be set "side to side" or "end to end", depending on the particular application. For purposes of the subsequent discussion, the shorter side of the individual floorboard will be referred to as its "end" and the longer side of the floorboard as its "side". Referring to FIG. 3, the floorboards 35 and 37 could have a connecting feature on their ends, such as a tongue 36 and groove 38, which would connect them in place as part of an assembled floor if a suitable horizontal force could be applied against the end of the individual floor panels. To be more specific, the end of the individual floorboard to be set is placed in notch 20 of flange 14 with the end surface of the individual floor panel contacting the vertical surface 24 in flange 14, and the horizontal surface 22 in flange 14 contacting the top surface of the floor panel to be set. The floor panel is thereby "accepted" in the notch 20, be prevented from lifting during the operation of tool 10. With the notch 20 accepting the floor panel to be set, the weighted slide 28 can be slid along the rod by the operator with a simple hand movement. It should be noted that the other hand of the operator would be on the handle 34, and this handle 34 could be used by the operator to initially place the notch 20 of the flange 14 in position relative to the floorboard to be set. As the weighted slide 28 hits the nut 30, which serves as an impact surface, momentum is built and a horizontal force is transmitted to the floorboard within the notch 20 of flange 14, thereby setting the floorboard in the assembled floor. During operation of the tool 10, the stabilizing ring preferably rests against the assembled floor surface, making the rod 12 substantially horizontal during operation of the tool 10. It should be appreciated that during operation of the tool 10 and setting of an individual floorboard, the operator would have one hand on the handle 34 and one hand free to slide the weighted slide 28. The handle 34 serves to keep the operator safe and in control during operation of the tool 10 as both hands are well away from the impact area of the weighted slide 28. Handle 34 also provides an enhanced level of control during the operation of the tool 10 not present in the prior art.

The presence of the notch 20, which accepts the floor panel to be set, allows use of the tool 10 in a very restricted area, such as under the toe-kick of a cabinet. It is specifically useful to set the last panels of laminate floors, which typically have a tongue and groove connection on their ends. To set the last panel near an obstruction, the tongue portion of that panel would be sawed off before it is set. Another feature of the tool 10 that is advantageous is that it can be "rolled" into or out of a relatively tight space. It other words, the tool 10 can be placed adjacent an obstruction with the stabilizing ring resting on the floor and the flange 14 either rotated ninety degrees into or out of a tight space. This feature is especially helpful if the obstructed area has an overhang or similar feature. Another feature that should be mentioned of the above described tool is that the upper surface of the horizontal portion 16 of flange 14 can be used as in impact surface for a downward blow from a hammer or the like to fit especially tight boards encountered during installation of a laminate floor.

The invention may be embodied in other forms without departing from the spirit or essential characteristics thereof. The present embodiments are, therefore, to be considered in all respects as illustrative and not restrictive, the scope of the invention being indicated by the appended claims rather than the foregoing description, and all change which comes within the meaning and range of equivalency of claims is intended to be embraced therein.

What I claim is:

1. A tool for setting individual floorboards in an assembled floor comprising:

a) a horizontal rod;

b) a flanged member at one end of said horizontal rod, said flanged member having a vertical portion and a horizontal portion, said vertical portion having a notch with a vertical notch portion and a horizontal notch portion therein adapted to accept a portion of an individual floorboard whereby the individual floorboard is contacted by said vertical notch portion and said horizontal notch portion, the contact of said horizontal notch portion of said notch with the individual floorboard preventing a vertical force component on the individual floorboard during operation of the tool;

c) a stabilizing ring having an annular outer surface, said stabilizing ring located at the end of said rod opposite of said flanged member, a portion of the annular outer surface of said stabilizing ring being the only contact of the tool with the assembled floor;

d) a weighted member used to build momentum slidably engaged on said horizontal rod between said flanged member and said stabilizing ring, whereby momentum is built as said weighted member slides along said rod toward said stabilizing ring and said momentum is transferred to said vertical portion of said flanged member allowing a horizontal force in the direction of the movement of said weighted member to be transmitted to the individual floor board engaged by said notch of said vertical member of said flanged member thereby setting the individual floorboard in the assembled floor.

2. The apparatus of claim 1 wherein the tool for setting individual floorboards in an assembled floor includes a nut adjacent to said stabilizing ring thereby fixing said stabilizing ring on said horizontal rod, and serving as an impact surface for said weighted member as it slides along said rod.

3. The apparatus of claim 1 wherein the tool for setting individual floorboards in an assembled floor includes a handle attached to said horizontal rod at the end of said horizontal rod opposite of said flanged member, whereby said handle in combination with said stabilizing ring provides control of said tool during operation with minimal contact of the tool with the assembled floor.

4. The apparatus of claim 1 which includes a web section between said rod and said flanged member.

5. A method for abutting an individual floorboard which is adjacent an obstruction to an assembled floor comprising:

a) placing a flanged member having a notch therein adapted to receive a portion of the floorboard to be abutted, said notch having a horizontal and vertical surface both contacting the floorboard and being connected to one end of a rod such that the rod rests in a substantially horizontal position when the horizontal and vertical surface of said notch of said flange member rests against the floorboard to be abutted, said rod contacting the assembled floor via a stabilizing ring having an annular outer surface, said stabilizing ring located at the end of said rod opposite of said flanged member, a portion of the annular outer surface of said stabilizing ring being the only contact of the tool with the assembled floor, and said rod having a weighted member used to build momentum slidably engaged thereto, said rod also having an impact member attached thereto in a manner that allows sufficient distance when said momentum building member slides along said rod to build enough momentum to abut the individual floorboard to the assembled floor;

b) sliding said weighted member in a direction toward said impact member whereby enough momentum is built as said weighted member contacts said impact member and the momentum is transferred to the individual floorboard to abut the individual floorboard to the assembled floor.

6. The method of claim 5 wherein said rod has a stabilizing ring connected thereto opposite said flanged member, said stabilizing ring rests on the assembled floor and supports said rod with said weighted member slidably engaged thereto.

7. The method of claim 6 wherein said stabilizing ring is configured such that the rod is substantially horizontal when the stabilizing ring rests on the assembled floor.

8. The method of claim 6 wherein said rod has a handle fixed thereto.

9. The method of claim 5 which includes a web section between said rod and said flanged member.

10. A tool for setting an individual floorboard which is adjacent to an obstruction to an assembled laminate floor wherein the individual floorboards of the laminate floor have a tongue and groove connection on their ends comprising:

a) a horizontal rod;

b) a flanged member at one end of said horizontal rod, said flanged member having a vertical portion and a horizontal portion, said vertical portion having a notch therein adapted to accept a portion of an individual floorboard, said notch having a vertical and horizontal surface which both contact the floorboard;

c) a stabilizing ring having an annular outer surface, said stabilizing ring located at the end of said rod opposite of said flanged member, a portion of the annular outer surface of said stabilizing ring being the only contact of the tool with the assembled floor;

d) a weighted member used to build momentum slidably engaged on said horizontal rod between said flanged member and said stabilizing ring, whereby momentum is built as said weighted member slides along said rod toward said stabilizing ring and said momentum is transferred to said vertical portion of said flanged member allowing a horizontal force in the direction of the movement of said weighted member to be transferred to the individual floorboard engaged by said notch of said vertical member of said flanged member thereby setting the individual floorboard in the laminate floor.

11. The apparatus of claim 10 wherein the tool includes a nut adjacent to said stabilizing ring thereby fixing said stabilizing ring on said horizontal rod, and serving as an impact surface for said weighted member as it slides along said rod.

12. The apparatus of claim 10 wherein the tool includes a handle attached to said horizontal rod at the end of said horizontal rod opposite of said flanged member, whereby said handle in combination with said stabilizing ring provides control of said tool during operation with minimal contact of the tool with the assembled floor.

13. The apparatus of claim 10 which includes a web section between said rod and said flanged member.

14. A method for abutting an individual floorboard which is adjacent to an obstruction to an assembled floor, the individual floorboard having a tongue and groove connection on its end, comprising:

a) placing a flanged member having a notch therein adapted to accept a portion of the floorboard to be abutted, said notch having a horizontal surface and a vertical surface both contacting the floorboard and being connected to one end of a rod such that the rod rests in a substantially horizontal position when the horizontal and vertical surface of said notch of said flanged member rests against the floorboard to be abutted, said rod contacting the assembled floor via a stabilizing ring having an annular outer surface, said stabilizing ring located at the end of said rod opposite of said flanged member, a portion of the annular outer surface of said stabilizing ring being the only contact of the tool with the assembled floor, and said rod having a weighted member used to build momentum slidably engaged thereto, said rod also having an impact member attached thereto in a manner that allows sufficient distance when said momentum building member slides along said rod to build enough momentum to abut the floorboard to the assembled floor;

b) sliding said weighted member in a direction toward said impact member whereby enough momentum is built as said weighted member contacts said impact member and the momentum is transferred to the individual floorboard to abut the floorboard to the assembled floor.

15. The method of claim 14 wherein said rod has a stabilizing ring connected thereto opposite said flanged member, said stabilizing ring rests on the assembled floor and supports said rod with said weighted member slidably engaged thereto.

16. The method of claim 15 wherein said stabilizing ring is configured such that the rod is substantially horizontal when the stabilizing ring rests on the assembled floor.

17. The method of claim 15 wherein said rod has a handle fixed thereto.

18. The method of claim 14 which includes a web section between said rod and said flanged member.

* * * * *